US008718502B2

(12) United States Patent
Yuasa et al.

(10) Patent No.: US 8,718,502 B2
(45) Date of Patent: May 6, 2014

(54) FIXING DEVICE AND IMAGE FORMING APPARATUS INCORPORATING SAME HAVING A TUBE WHICH PENETRATES THROUGH A HEATER AND PASSES INFRARED RAYS TO A TEMPERATURE DETECTOR

(75) Inventors: Shuutaroh Yuasa, Kanagawa (JP); Masanao Ehara, Kanagawa (JP); Tadashi Ogawa, Tokyo (JP); Satoshi Ueno, Tokyo (JP); Hiroshi Seo, Kanagawa (JP); Teppei Kawata, Kanagawa (JP); Shuntaroh Tamaki, Kanagawa (JP); Takamasa Hase, Tokyo (JP); Kazuya Saito, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 173 days.

(21) Appl. No.: 13/366,939

(22) Filed: Feb. 6, 2012

(65) Prior Publication Data

US 2012/0219312 A1 Aug. 30, 2012

(30) Foreign Application Priority Data

Feb. 25, 2011 (JP) ..... 2011-040631

(51) Int. Cl.
*G03G 15/20* (2006.01)

(52) U.S. Cl.
USPC ..... 399/69

(58) Field of Classification Search
USPC ..... 399/69
See application file for complete search history.

(56) References Cited

U.S. PATENT DOCUMENTS

| | | | | |
|---|---|---|---|---|
| 5,832,354 | A | 11/1998 | Kouno et al. | |
| 5,915,147 | A | 6/1999 | Kouno et al. | |
| 6,219,520 | B1 | 4/2001 | Ehara | |
| 6,628,916 | B2 | 9/2003 | Yasui et al. | |
| 6,636,709 | B2 | 10/2003 | Furukawa et al. | |
| 6,684,037 | B2 * | 1/2004 | Tamaoki | 399/69 |
| 6,778,790 | B2 | 8/2004 | Yoshinaga et al. | |

(Continued)

FOREIGN PATENT DOCUMENTS

| | | |
|---|---|---|
| JP | 2008-39846 | 2/2008 |
| JP | 2009-288396 | 12/2009 |

OTHER PUBLICATIONS

U.S. Appl. No. 13/200,592, filed Sep. 27, 2011.
U.S. Appl. No. 13/137,852, filed Sep. 19, 2011.

(Continued)

*Primary Examiner* — G. M. Hyder
(74) *Attorney, Agent, or Firm* — Oblon, Spivak, McClelland, Maier & Neustadt, L.L.P.

(57) ABSTRACT

A fixing device includes a fixing rotary body rotatable in a predetermined direction of rotation to radiate infrared rays; a pressing rotary body, rotatable in a direction counter to the direction of rotation of the fixing rotary body, pressed against the fixing rotary body to form a fixing nip therebetween through which a recording medium bearing a toner image is conveyed; a heater disposed opposite the fixing rotary body to heat the fixing rotary body; a temperature detector spaced apart from the fixing rotary body to detect a temperature of the fixing rotary body based on the infrared rays from the fixing rotary body and disposed below the fixing nip in a vertical direction; and a tube disposed between the fixing rotary body and the temperature detector, the tube through which the infrared rays from the fixing rotary body enter the temperature detector.

15 Claims, 3 Drawing Sheets

(56) References Cited

U.S. PATENT DOCUMENTS

| | | | | |
|---|---|---|---|---|
| 6,785,505 | B2 | 8/2004 | Yasui et al. | |
| 6,807,386 | B2 | 10/2004 | Yasui et al. | |
| 6,881,927 | B2 | 4/2005 | Yoshinaga et al. | |
| 6,892,044 | B2 | 5/2005 | Yasui et al. | |
| 7,022,944 | B2 | 4/2006 | Yoshinaga et al. | |
| 7,027,075 | B2 * | 4/2006 | Yokoi | 347/156 |
| 7,266,336 | B2 | 9/2007 | Ueno et al. | |
| 7,433,619 | B2 * | 10/2008 | Suzuki et al. | 399/69 |
| 7,440,713 | B2 * | 10/2008 | Sone et al. | 399/122 |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,546,049 | B2 | 6/2009 | Ehara et al. | |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,742,714 | B2 | 6/2010 | Shinshi et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 7,925,177 | B2 | 4/2011 | Ishii et al. | |
| 7,983,582 | B2 | 7/2011 | Hase | |
| 8,014,711 | B2 | 9/2011 | Ito et al. | |
| 8,023,861 | B2 | 9/2011 | Yoshinaga et al. | |
| 8,050,607 | B2 | 11/2011 | Shinshi et al. | |
| 2004/0057493 | A1 * | 3/2004 | Ishikawa et al. | 374/120 |
| 2004/0086295 | A1 * | 5/2004 | Peng et al. | 399/69 |
| 2004/0109490 | A1 * | 6/2004 | Asakura et al. | 374/133 |
| 2006/0257183 | A1 | 11/2006 | Ehara et al. | |
| 2007/0014600 | A1 | 1/2007 | Ishii et al. | |
| 2007/0280713 | A1 * | 12/2007 | Tsueda et al. | 399/69 |
| 2007/0280754 | A1 | 12/2007 | Ogawa et al. | |
| 2008/0063443 | A1 | 3/2008 | Yoshinaga et al. | |
| 2008/0317532 | A1 | 12/2008 | Ehara et al. | |
| 2009/0060550 | A1 | 3/2009 | Seo | |
| 2009/0123201 | A1 | 5/2009 | Ehara et al. | |
| 2009/0148205 | A1 | 6/2009 | Seo et al. | |
| 2009/0245897 | A1 | 10/2009 | Seo et al. | |
| 2010/0014903 | A1 | 1/2010 | Seto et al. | |
| 2010/0061753 | A1 | 3/2010 | Hase | |
| 2010/0074667 | A1 | 3/2010 | Ehara et al. | |
| 2010/0158553 | A1 | 6/2010 | Ueno | |
| 2010/0232844 | A1 | 9/2010 | Saito et al. | |
| 2010/0239292 | A1 | 9/2010 | Fujita et al. | |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064443 | A1 | 3/2011 | Iwaya et al. | |
| 2011/0064450 | A1 | 3/2011 | Ishii et al. | |
| 2011/0064451 | A1 | 3/2011 | Yamaguchi et al. | |
| 2011/0064490 | A1 | 3/2011 | Imada et al. | |
| 2011/0064494 | A1 | 3/2011 | Amita et al. | |
| 2011/0064502 | A1 * | 3/2011 | Hase et al. | 399/406 |
| 2011/0076071 | A1 | 3/2011 | Yamaguchi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182638 | A1 | 7/2011 | Ishii et al. | |
| 2011/0188911 | A1 | 8/2011 | Kunii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229180 | A1 | 9/2011 | Saito | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0293309 | A1 * | 12/2011 | Hase | 399/69 |
| 2011/0311284 | A1 | 12/2011 | Seo et al. | |
| 2012/0008153 | A1 | 1/2012 | Kunii et al. | |

OTHER PUBLICATIONS

U.S. Appl. No. 13/217,488, filed Aug. 25, 2011, Yutaka Ikebuchi, et al.

U.S. Appl. No. 13/212,718, filed Aug. 18, 2011, Takamasa Hase, et al.

U.S. Appl. No. 13/221,340, filed Aug. 30, 2011, Satoshi Ueno, et al.

U.S. Appl. No. 13/280,946, filed Oct. 25, 2011, Takamasa Hase, et al.

* cited by examiner

FIXING DEVICE AND IMAGE FORMING APPARATUS INCORPORATING SAME HAVING A TUBE WHICH PENETRATES THROUGH A HEATER AND PASSES INFRARED RAYS TO A TEMPERATURE DETECTOR

CROSS-REFERENCE TO RELATED APPLICATIONS

This patent application is based on and claims priority pursuant to 35 U.S.C. §119 to Japanese Patent Application No. 2011-040631, filed on Feb. 25, 2011, in the Japanese Patent Office, the entire disclosure of which is hereby incorporated herein by reference.

FIELD OF THE INVENTION

Exemplary aspects of the present invention relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ an induction heater to warm up the fixing device quickly. For example, the induction heater is disposed opposite the outer circumferential surface of a fixing roller to heat the fixing roller. The fixing roller presses against a pressing roller to form a fixing nip therebetween through which the recording medium bearing the toner image is conveyed. As the recording medium passes through the fixing nip, the fixing roller heated by the induction heater and the pressing roller apply heat and pressure to the recording medium, melting and fixing the toner image on the recording medium.

A thermopile is disposed opposite the outer circumferential surface of the fixing roller to detect the temperature of the fixing roller based on which a heating amount of the induction heater for heating the fixing roller is adjusted. However, the thermopile raises a problem that it may detect not only infrared rays from the fixing roller but also infrared rays from the components other than the fixing roller, resulting in faulty detection of the temperature of the fixing roller. To address this problem, the thermopile is disposed opposite the fixing roller via a through-hole produced in the induction heater. Accordingly, the thermopile detects infrared rays radiated from the fixing roller and traveling through the through-hole only, thus detecting the temperature of the fixing roller precisely.

Although effective for its intended purpose, the through-hole raises another problem. That is, as the recording medium bearing the unfixed toner image is conveyed through the fixing nip, heat conducted from the fixing roller vaporizes water contained in the recording medium into steam and volatilizes wax contained in toner of the unfixed toner image. When the steam and volatilized wax move from the fixing nip into the through-hole of the induction heater, they may adhere to the interior wall of the through-hole, causing detection error of the thermopile.

Accordingly, there is a need for a technology that prevents faulty detection of the temperature of the fixing roller by the thermopile caused by the infrared rays radiated from the components other than the fixing roller and the steam and volatilized wax generated from the recording medium bearing the toner image at the fixing nip.

SUMMARY OF THE INVENTION

This specification describes below an improved fixing device. In one exemplary embodiment of the present invention, the fixing device includes a fixing rotary body rotatable in a predetermined direction of rotation to radiate infrared rays; a pressing rotary body, rotatable in a direction counter to the direction of rotation of the fixing rotary body, pressed against the fixing rotary body to form a fixing nip therebetween through which a recording medium bearing a toner image is conveyed; a heater disposed opposite the fixing rotary body to heat the fixing rotary body; a temperature detector spaced apart from the fixing rotary body to detect a temperature of the fixing rotary body based on the infrared rays from the fixing rotary body and disposed below the fixing nip in a vertical direction; and a tube disposed between the fixing rotary body and the temperature detector, the tube through which the infrared rays from the fixing rotary body enter the temperature detector.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
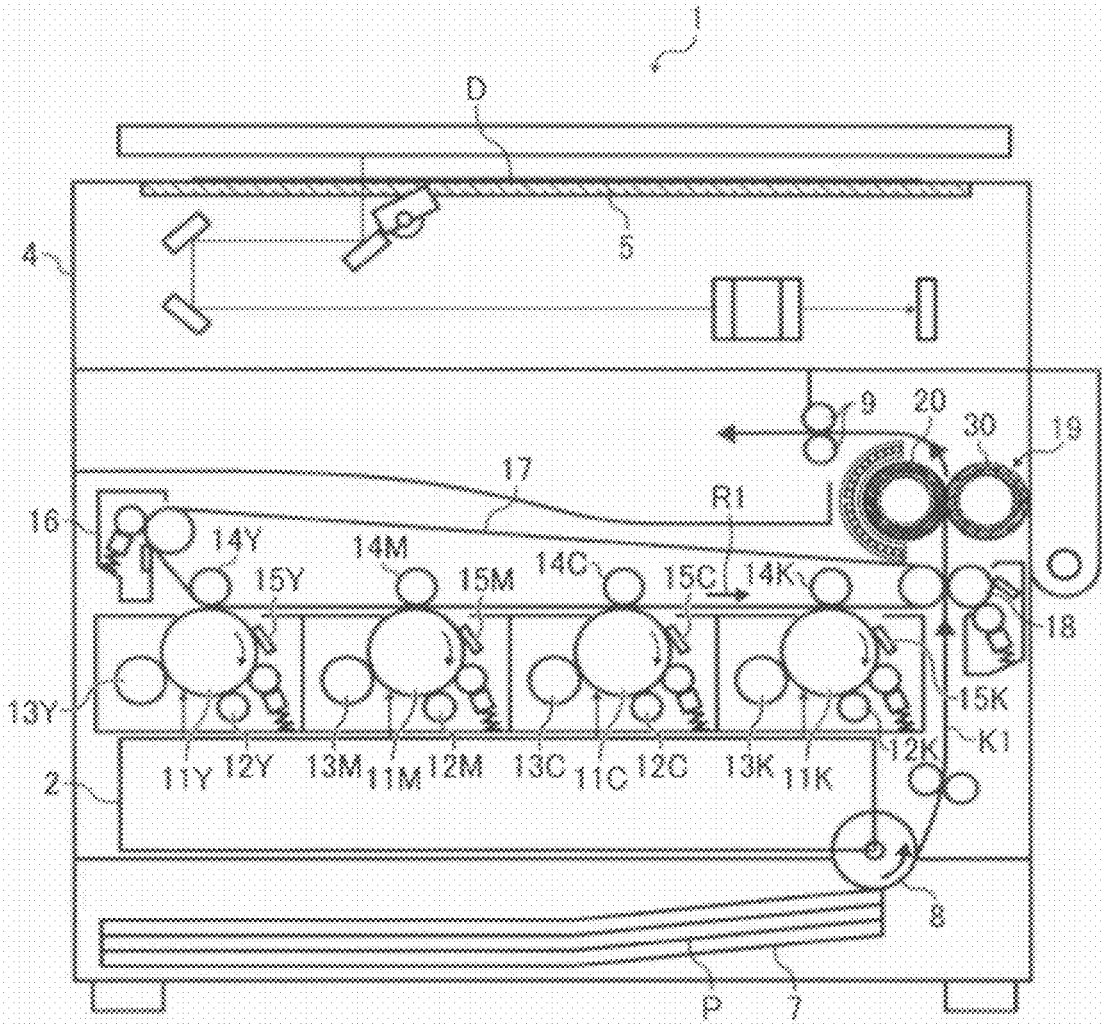
FIG. 1 is a schematic sectional view of an image forming apparatus according to a first embodiment.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to a first embodiment of the present invention is explained.

A description is now given of the structure of the image forming apparatus 1 with reference to FIG. 1.

FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment, the image forming apparatus 1 is a tandem color copier for forming a color image on a recording medium by electrophotography. The image forming apparatus 1 includes an original document reader 4 disposed in an upper portion of the image forming apparatus 1 to read an image on an original document D placed on an exposure glass 5 disposed atop the image forming apparatus 1 into image data. Below the original document reader 4 in a lower portion of the image forming apparatus 1 is a writer 2 that emits laser beams onto photoconductive drums 11Y, 11M, 11C, and 11K surrounded by chargers 12Y, 12M, 12C, and 12K, development devices 13Y, 13M, 13C, and 13K, and cleaners 15Y, 15M, 15C, and 15K, respectively. Specifically, the writer 2 emits the laser beams onto the photoconductive drums 11Y, 11M, 11C, and 11K charged by the chargers 12Y, 12M, 12C, and 12K according to the image data sent from the original document reader 4, thus forming electrostatic latent images on the photoconductive drums 11Y, 11M, 11C, and 11K. The development devices 13Y, 13M, 13C, and 13K visualize the electrostatic latent images formed on the photoconductive drums 11Y, 11M, 11C, and 11K with yellow, magenta, cyan, and black toners into yellow, magenta, cyan, and black toner images, respectively. Thus, the photoconductive drums 11Y, 11M, 11C, and 11K serve as image carriers that carry the electrostatic latent images and the resultant toner images. The photoconductive drums 11Y, 11M, 11C, and 11K are disposed opposite primary transfer rollers 14Y, 14M, 14C, and 14K. The primary transfer rollers 14Y, 14M, 14C, and 14K transfer and superimpose the yellow, magenta, cyan, and black toner images from the photoconductive drums 11Y, 11M, 11C, and 11K onto an intermediate transfer belt 17 looped over the primary transfer rollers 14Y, 14M, 14C, and 14K, thus forming a color toner image on the intermediate transfer belt 17. After the transfer of the yellow, magenta, cyan, and black toner images from the photoconductive drums 11Y, 11M, 11C, and 11K, the cleaners 15Y, 15M, 15C, and 15K remove residual toner not transferred onto the intermediate transfer belt 17 and therefore remaining on the intermediate transfer belt 17 therefrom.

Below the writer 2 is a paper tray 7 that loads a plurality of recording media P (e.g., sheets). Above the paper tray 7 is a feed roller 8 that picks up and feeds an uppermost recording medium P from the paper tray 7 toward a secondary transfer roller 18 disposed opposite the intermediate transfer belt 17 to transfer the color toner image formed on the intermediate transfer belt 17 onto the recording medium P conveyed from the paper tray 7. A belt cleaner 16 is disposed opposite the intermediate transfer belt 17 to remove residual toner not transferred onto the recording medium P and therefore remaining on the intermediate transfer belt 17 therefrom. Above the secondary transfer roller 18 is a fixing device 19 that fixes the color toner image on the recording medium P by heating the recording medium P by electromagnetic induction. Above the fixing device 19 is an output roller pair 9 that discharges the recording medium P bearing the fixed color toner image conveyed from the fixing device 19 to an outside of the image forming apparatus 1.

A description is now given of the operation of the image forming apparatus 1 having the above-described structure to form a color toner image on a recording medium P.

The original document reader 4 optically reads an image on the original document D placed on the exposure glass 5 into image data. For example, a lamp of the original document reader 4 emits a light beam onto the original document D bearing the image in such a manner that the light beam scans the original document D. The light beam reflected by the original document D travels to a color sensor through mirrors and a lens, where the image is formed. The color sensor reads and separates the image into red, green, and blue images, and converts the images into electric image signals for red, green, and blue. Based on the respective electric image signals, an image processor of the original document reader 4 performs processing such as color conversion, color correction, and space frequency correction, thus producing yellow, magenta, cyan, and black image data.

Thereafter, the yellow, magenta, cyan, and black image data are sent to the writer 2. The writer 2 emits laser beams onto the photoconductive drums 11Y, 11M, 11C, and 11K according to the yellow, magenta, cyan, and black image data sent from the original document reader 4.

A detailed description is now given of five processes performed on the photoconductive drums 11Y, 11M, 11C, and 11K, that is, a charging process, an exposure process, a development process, a primary transfer process, and a cleaning process.

The four photoconductive drums 11Y, 11M, 11C, and 11K rotate clockwise in FIG. 1. In the charging process, the chargers 12Y, 12M, 12C, and 12K, disposed opposite the photoconductive drums 11Y, 11M, 11C, and 11K, uniformly charge an outer circumferential surface of the respective photoconductive drums 11Y, 11M, 11C, and 11K, thus generating a charging potential on the respective photoconductive drums 11Y, 11M, 11C, and 11K. Thereafter, the charged outer circumferential surface of the respective photoconductive drums 11Y, 11M, 11C, and 11K reaches a position where it receives a laser beam from the writer 2.

In the exposure process, four light sources of the writer 2, disposed opposite the photoconductive drums 11Y, 11M, 11C, and 11K, emit laser beams according to the yellow, magenta, cyan, and black image data, respectively. The laser beams corresponding to the yellow, magenta, cyan, and black image data travel through different optical paths, respectively.

For example, the laser beam corresponding to the yellow image data irradiates the outer circumferential surface of the leftmost photoconductive drum 11Y in FIG. 1. Specifically, a polygon mirror of the writer 2, which rotates at a high speed, causes the laser beam corresponding to the yellow image data to scan the charged outer circumferential surface of the photoconductive drum 11Y in an axial direction thereof, that is, a main scanning direction. Thus, an electrostatic latent image is formed on the outer circumferential surface of the photoconductive drum 11Y charged by the charger 12Y according to the yellow image data.

Similarly, the laser beam corresponding to the magenta image data irradiates the outer circumferential surface of the second photoconductive drum 11M from the left in FIG. 1, forming an electrostatic latent image according to the magenta image data. The laser beam corresponding to the cyan image data irradiates the outer circumferential surface of the third photoconductive drum 11C from the left in FIG. 1, forming an electrostatic latent image according to the cyan image data. The laser beam corresponding to the black image data irradiates the outer circumferential surface of the rightmost photoconductive drum 11K in FIG. 1, forming an electrostatic latent image according to the black image data.

Thereafter, the outer circumferential surface of the respective photoconductive drums 11Y, 11M, 11C, and 11K formed with the electrostatic latent images reaches a position where the photoconductive drums 11Y, 11M, 11C, and 11K are disposed opposite the development devices 13Y, 13M, 13C, and 13K, respectively.

In the development process, the development devices 13Y, 13M, 13C, and 13K disposed opposite the photoconductive drums 11Y, 11M, 11C, and 11K supply yellow, magenta, cyan, and black toners to the electrostatic latent images formed on the photoconductive drums 11Y, 11M, 11C, and 11K, respectively, thus rendering the electrostatic latent images visible as yellow, magenta, cyan, and black toner images. Thereafter, the outer circumferential surface of the respective photoconductive drums 11Y, 11M, 11C, and 11K formed with the yellow, magenta, cyan, and black toner images reaches a position where the photoconductive drums 11Y, 11M, 11C, and 11K are disposed opposite the intermediate transfer belt 17. The four primary transfer rollers 14Y, 14M, 14C, and 14K are disposed opposite the four photoconductive drums 11Y, 11M, 11C, and 11K, respectively, via the intermediate transfer belt 17 in a state in which the primary transfer rollers 14Y, 14M, 14C, and 14K contact an inner circumferential surface of the intermediate transfer belt 17.

In the primary transfer process, the primary transfer rollers 14Y, 14M, 14C, and 14K transfer the yellow, magenta, cyan, and black toner images from the photoconductive drums 11Y, 11M, 11C, and 11K onto the intermediate transfer belt 17 rotating counterclockwise in FIG. 1 in a rotation direction R1 successively in such a manner that the yellow, magenta, cyan, and black toner images are superimposed on the same position on an outer circumferential surface of the intermediate transfer belt 17, thus producing a color toner image on the intermediate transfer belt 17.

Thereafter, the outer circumferential surface of the respective photoconductive drums 11Y, 11M, 11C, and 11K that no longer carry the yellow, magenta, cyan, and black toner images reaches a position where the photoconductive drums 11Y, 11M, 11C, and 11K are disposed opposite the cleaners 15Y, 15M, 15C, and 15K, respectively.

In the cleaning process, the cleaners 15Y, 15M, 15C, and 15K disposed opposite the photoconductive drums 11Y, 11M, 11C, and 11K collect residual toners not transferred and therefore remaining on the photoconductive drums 11Y, 11M, 11C, and 11K from the photoconductive drums 11Y, 11M, 11C, and 11K, respectively. Thereafter, dischargers disposed opposite the photoconductive drums 11Y, 11M, 11C, and 11K discharge the outer circumferential surface of the respective photoconductive drums 11Y, 11M, 11C, and 11K, thus completing a series of processes performed on the photoconductive drums 11Y, 11M, 11C, and 11K. The outer circumferential surface of the intermediate transfer belt 17 transferred with the color toner image reaches a position where it is disposed opposite the secondary transfer roller 18, that is, a secondary transfer nip. Specifically, the secondary transfer nip is created by the secondary transfer roller 18 and a secondary transfer backup roller that sandwich the intermediate transfer belt 17. As a recording medium P conveyed from the paper tray 7 passes through the secondary transfer nip, the color toner image formed on the intermediate transfer belt 17 is transferred onto the recording medium P in the secondary transfer process.

After the transfer of the color toner image from the intermediate transfer belt 17, residual toner not transferred onto the recording medium P remains on the intermediate transfer belt 17. Thereafter, the outer circumferential surface of the intermediate transfer belt 17 that no longer carries the color toner image reaches a position where it is disposed opposite the belt cleaner 16. The belt cleaner 16 collects the residual toner from the intermediate transfer belt 17, thus completing a series of processes performed on the intermediate transfer belt 17.

A detailed description is now given of two processes performed on the recording medium P, that is, the secondary transfer process described above and a fixing process.

The recording medium P is conveyed from the paper tray 7 disposed in the lower portion of the image forming apparatus 1 to the secondary transfer nip through a conveyance path K1 disposed with the feed roller 8 and the registration roller pair. For example, the paper tray 7 contains a plurality of recording media P. As the feed roller 8 rotates counterclockwise in FIG. 1, it feeds an uppermost recording medium P to the conveyance path K1. The recording medium P conveyed through the conveyance path K1 is stopped temporarily by the registration roller pair at a nip formed between two rollers of the registration roller pair. When the registration roller pair resumes rotating, it feeds the recording medium P to the secondary transfer nip at a proper time for transferring the color toner image formed on the intermediate transfer belt 17 onto the recording medium P. Thus, a desired color toner image is transferred onto the recording medium P in the secondary transfer process described above.

After the secondary transfer process, the recording medium P bearing the color toner image is conveyed to the fixing device 19 incorporated with a fixing roller 20 and a pressing roller 30. As the recording medium P bearing the color toner image passes between the fixing roller 20 and the pressing roller 30, they apply heat and pressure to the recording medium P to fix the color toner image on the recording medium P. Then, the output roller pair 9 disposed downstream from the fixing device 19 in a conveyance direction of the recording medium P discharges the recording medium P bearing the fixed color toner image in a direction indicated by the broken line arrow to the outside of the image forming apparatus 1, thus completing a series of processes for forming the color toner image on the recording medium P.

Figure 2:
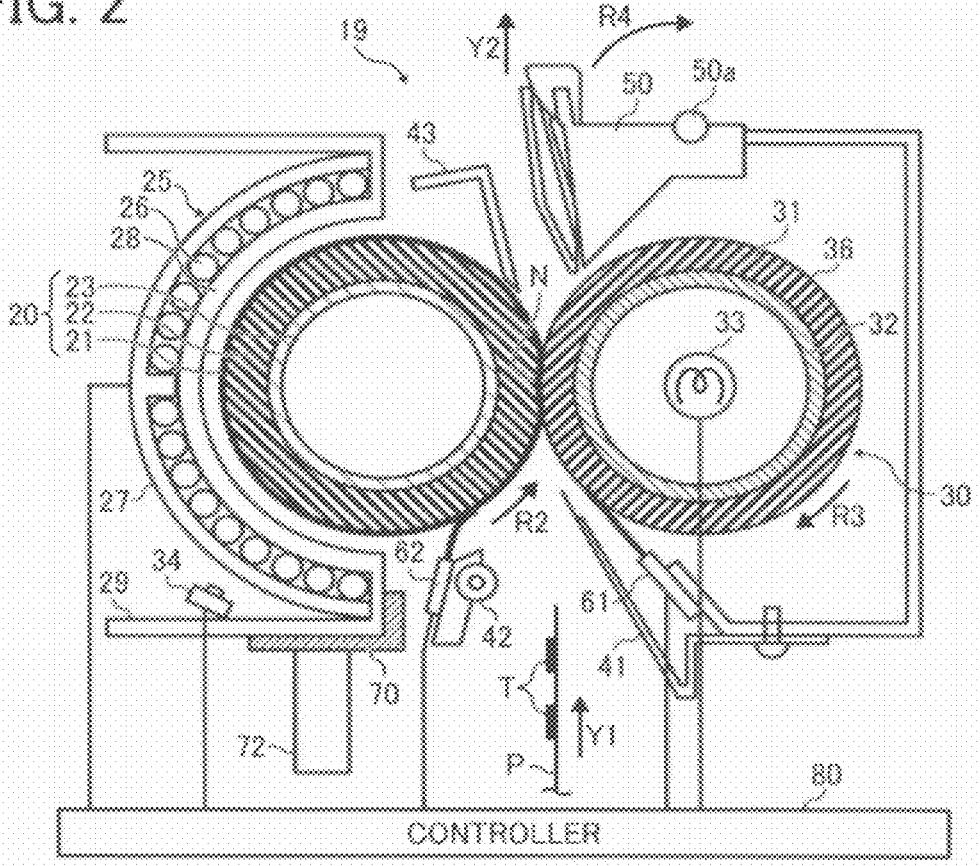
FIG. 2 is a vertical sectional view of a fixing device installed in the image forming apparatus shown in FIG. 1.
Figure 3:
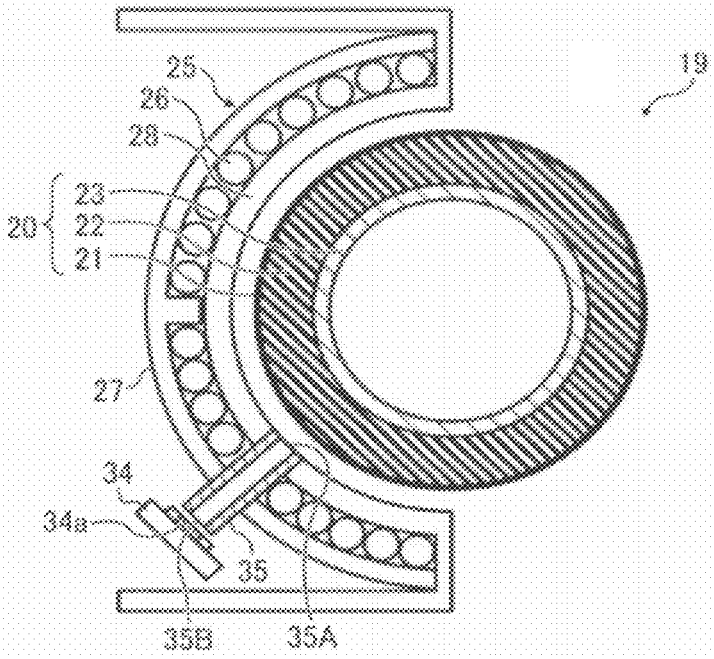
FIG. 3 is a partial vertical sectional view of the fixing device shown in FIG. 2.

Referring to FIGS. 2 and 3, the following describes the structure and operation of the fixing device 19 installed in the image forming apparatus 1 described above. FIG. 2 is a vertical sectional view of the fixing device 19. FIG. 3 is a partial vertical sectional view of the fixing device 19.

As illustrated in FIG. 2, the fixing device 19 (e.g., a fuser unit) includes the fixing roller 20 serving as a fixing rotary body; the pressing roller 30 serving as a pressing rotary body pressed against the fixing roller 20 to form a fixing nip N therebetween through which a recording medium P bearing a toner image T passes; an induction heater 25 serving as a heater or a magnetic flux generator disposed opposite the fixing roller 20; an entrance guide 41 (e.g., a plate) disposed upstream from the fixing nip N in the conveyance direction of the recording medium P; a spur guide 42 (e.g., a plate) disposed opposite the entrance guide 41 and upstream from the fixing nip N in the conveyance direction of the recording medium P; a separation guide 43 (e.g., a plate) disposed downstream from the fixing nip N in the conveyance direction of the recording medium P; an exit guide 50 (e.g., a plate) disposed opposite the separation guide 43 and downstream from the fixing nip N in the conveyance direction of the recording medium P; a thermistor 61 disposed upstream from the fixing nip N in the conveyance direction of the recording medium P and contacting the pressing roller 30; and a thermistor 62 disposed upstream from the fixing nip N in the conveyance direction of the recording medium P and contacting the fixing roller 20.

A detailed description is now given of the fixing roller 20.

The fixing roller 20 having an outer diameter of about 40 mm is constructed of three layers: a metal core 23 made of iron, stainless steel, or the like; a heat insulating elastic layer 22 disposed on the metal core 23 and made of silicone rubber foam or the like; and a sleeve layer 21 disposed on the heat insulating elastic layer 22.

The sleeve layer 21 has a multilayer structure constructed of a base layer constituting an inner circumferential surface, a first antioxidant layer, a heat generating layer, a second antioxidant layer, an elastic layer, and a release layer. For example, the base layer having a thickness of about 40 micrometers is made of stainless steel or the like. The first antioxidant layer and the second antioxidant layer are treated with nickel strike plating with a thickness of about 1 micrometer or smaller. The heat generating layer having a thickness of about 10 micrometers is made of copper or the like. The elastic layer having a thickness of about 150 micrometers is made of silicone rubber or the like. The release layer having a thickness of about 30 micrometers is made of tetrafluoroethylene-perfluoroalkylvinylether copolymer (PFA) or the like. With the above-described structure, the heat generating layer of the sleeve layer 21 of the fixing roller 20 is heated by electromagnetic induction by a magnetic flux generated by the induction heater 25.

It is to be noted that the structure of the fixing roller 20 is not limited to the above. For example, the sleeve layer 21 may be separately provided from the heat insulating elastic layer 22 by not being adhered to the heat insulating elastic layer 22. In this case, the heat insulating elastic layer 22 serves as a supplemental fixing roller. Further, it is preferable that the fixing roller 20 may further include a mechanism that prevents the sleeve layer 21 from shifting from the heat insulating elastic layer 22 in an axial direction, that is, a thrust direction, of the fixing roller 20 as the fixing roller 20 rotates.

A detailed description is now given of the components surrounding the fixing roller 20.

The spur guide 42 is disposed opposite the fixing roller 20 and upstream from the fixing nip N in the conveyance direction of the recording medium P. The spur guide 42 includes a plurality of spurs arranged in the axial direction of the fixing roller 20 substantially orthogonal to the conveyance direction of the recording medium P. The spur guide 42 is disposed opposite an image side of the recording medium P conveyed toward the fixing nip N, guiding the recording medium P to the fixing nip N. The plurality of spurs of the spur guide 42 has a sawtooth circumferential surface portion to prevent the plurality of spurs from scratching and damaging the toner image T on the recording medium P even when the plurality of spurs contacts the image side of the recording medium P.

The separation guide 43 is disposed opposite the fixing roller 20 and downstream from the fixing nip N in the conveyance direction of the recording medium P. The separation guide 43 is disposed opposite the image side of the recording medium P conveyed from the fixing nip N. The separation guide 43 prevents the recording medium P bearing the fixed toner image T from being attracted and adhered to the fixing roller 20 as the recording medium P is discharged from the fixing nip N. For example, if the recording medium P is attracted to the fixing roller 20, the separation guide 43 contacts a leading edge of the recording medium P and separates the recording medium P from the fixing roller 20.

The thermistor 62 is disposed in proximity to and upstream from the fixing nip N in the conveyance direction of the recording medium P. The thermistor 62 serving as a contact temperature detecting sensor contacts the fixing roller 20 at one lateral end of the fixing roller 20 in the axial direction thereof where the fixing roller 20 is driven, thus detecting a surface temperature of the fixing roller 20.

A thermopile 34 serving as a non-contact temperature detector is disposed opposite the fixing roller 20 at a center of the fixing roller 20 in the axial direction thereof.

A thermopile is an element that detects a temperature of an object based on infrared rays radiated from the object. For example, the infrared rays radiated from the object are absorbed by a thermal conversion film disposed inside the thermopile and converted into heat. Thereafter, lots of small thermocouples disposed on the thermal conversion film detect the heat as a temperature.

The thermistor 62 and the thermopile 34 described above detect the temperature of the fixing roller 20, that is, a fixing temperature at which the toner image T is fixed on the recording medium P. The thermistor 62 and the thermopile 34 are operatively connected to a controller 80, that is, a central processing unit (CPU) provided with a random-access memory (RAM) and a read-only memory (ROM), for example. The controller 80 is operatively connected to the induction heater 25 to control the induction heater 25 to adjust a heating amount of the induction heater 25 that heats the fixing roller 20 based on the temperature of the fixing roller 20 detected by the thermistor 62 and the thermopile 34. According to this exemplary embodiment, the controller 80 controls the induction heater 25 to heat the fixing roller 20 to the temperature in a range of from about 160 degrees centigrade to about 165 degrees centigrade during the fixing process, that is, when the recording medium P bearing the toner image T passes through the fixing nip N.

As shown in FIG. 2, the pressing roller 30 is constructed of three layers: a tubular core 32 made of steel, aluminum, or the like; an elastic layer 31 disposed on the core 32 and made of silicone rubber or the like; and a release layer 36 disposed on the elastic layer 31 and made of PFA or the like. The elastic layer 31 has a thickness in a range of from about 1 mm to about 5 mm. The release layer 36 has a thickness in a range of from about 20 micrometers to about 200 micrometers. The pressing roller 30 is pressed against the fixing roller 20 to form the fixing nip N therebetween. A recording medium P bearing an unfixed toner image T is conveyed in a direction Y1 to the fixing nip N. According to this exemplary embodiment shown in FIG. 2, a heater 33 (e.g., a halogen heater) is disposed inside the pressing roller 30 to heat the pressing roller 30 which in turn heats the fixing roller 20 more effectively. For example, when power is supplied to the heater 33, the heater 33 emits light and radiation heat to heat the pressing roller 30. Then, the pressing roller 30 heats the fixing roller 20.

The thermistor 61 is disposed in proximity to and upstream from the fixing nip N in the conveyance direction of the recording medium P. The thermistor 61 serves as a contact temperature detecting sensor that contacts the pressing roller 30 at one lateral end of the pressing roller 30 in an axial direction thereof where the pressing roller 30 is driven, thus detecting a surface temperature of the pressing roller 30. The thermistor 61 described above detects the temperature of the pressing roller 30. The thermistor 61 is operatively connected to the controller 80 that is operatively connected to the heater 33 to control the heater 33 to adjust a heating amount of the heater 33 that heats the pressing roller 30 based on the temperature of the pressing roller 30 detected by the thermistor 61.

The entry guide 41 is disposed upstream from the fixing nip N in the conveyance direction of the recording medium P. The entry guide 41 is opposite the pressing roller 30 and a non-image side of the recording medium P not bearing the unfixed toner image T conveyed toward the fixing nip N, thus guiding the recording medium P to the fixing nip N.

It is to be noted that the non-image side of the recording medium P defines a side of the recording medium P that bears no unfixed toner image, that is, the side of the recording medium P that bears no toner image or bears the fixed toner image in duplex printing.

The exit guide 50 is disposed downstream from the fixing nip N in the conveyance direction of the recording medium P. The exit guide 50 is disposed opposite the pressing roller 30 and the non-image side of the recording medium P discharged from the fixing nip N. The exit guide 50 guides the recording medium P bearing the fixed toner image T discharged from the fixing nip N in a direction Y2 to a conveyance path disposed downstream from the fixing device 19 in the conveyance direction of the recording medium P. The exit guide 50 is rotatable about a shaft 50*a* in a rotation direction R4.

The induction heater 25 serving as a heater or a magnetic flux generator includes a coil 26 (e.g., an exciting coil), a core 27 (e.g., an exciting coil core), a coil guide 28, and a frame 29. The coil 26 is constructed of litz wire made of bundled thin wire wound around the coil guide 28 that covers a part of an outer circumferential surface of the fixing roller 20 and extending in the axial direction of the fixing roller 20. The coil guide 28 is made of a heat resistant resin such as polyethylene-terephthalate (PET) that contains glass at a rate of about 45 percent. The coil guide 28 is disposed opposite the fixing roller 20 to hold the coil 26 with respect to the outer circumferential surface of the fixing roller 20. According to this exemplary embodiment, the outer circumferential surface of the fixing roller 20 is spaced by a distance in a range of from about 1.9 mm to about 2.1 mm apart from an inner circumferential surface of the coil guide 28 that faces the outer circumferential surface of the fixing roller 20. The core 27 is made of ferromagnet such as ferrite having a magnetic permeability of about 2,500 and is constructed of an arch core, a center core, and a side core to generate a magnetic flux toward the heat generating layer of the fixing roller 20 effectively.

According to this exemplary embodiment, the induction heater 25 is disposed opposite the left half of the fixing roller 20 in FIG. 2, that is, one half of the outer circumferential surface of the fixing roller 20 that is opposite another half thereof disposed opposite the pressing roller 30.

Referring to FIG. 2, the following describes the operation of the fixing device 19 having the above-described structure.

A driver (e.g., a motor) drives and rotates the fixing roller 20 counterclockwise in FIG. 2 in a rotation direction R2. The rotating fixing roller 20 in turn rotates the pressing roller 30 clockwise in FIG. 2 in a rotation direction R3 counter to the rotation direction R2 of the fixing roller 20. The induction heater 25 disposed opposite the fixing roller 20 generates a magnetic flux to heat the heat generating layer of the sleeve layer 21 of the fixing roller 20. For example, a frequency variable power supply of an oscillator circuit sends a high frequency alternating current in a range of from about 10 kHz to about 1 MHz, preferably in a range of from about 20 kHz to about 800 kHz, to the coil 26. Accordingly, the coil 26 generates magnetic lines of force alternately switched bidirectionally toward the sleeve layer 21 of the fixing roller 20, thus generating an alternating magnetic field. The alternating magnetic field generates an eddy current in the heat generating layer of the sleeve layer 21, which causes the heat generating layer to generate Joule heat by its electric resistance. Thus, the sleeve layer 21 heats itself by induction heating of the heat generating layer thereof.

Thereafter, as the fixing roller 20 rotates in the rotation direction R2, a portion of the outer circumferential surface of the fixing roller 20 heated by the induction heater 25 reaches the fixing nip N formed between the fixing roller 20 and the pressing roller 30 contacting each other. As a recording medium P bearing an unfixed toner image T is conveyed through the fixing nip N, the fixing roller 20 heats and melts the unfixed toner image T on the recording medium P. For example, the recording medium P bearing the toner image T formed by the above-described image forming processes is conveyed in the direction Y1 to the fixing nip N while guided by the entry guide 41 or the spur guide 42. As the recording medium P bearing the toner image T passes through the fixing nip N, the fixing roller 20 heats the recording medium P and at the same time the pressing roller 30 applies pressure to the recording medium P, thus melting and fixing the toner image T on the recording medium P. Then, the recording medium P is discharged from the fixing nip N and is conveyed in the direction Y2.

After the recording medium P bearing the fixed toner image T is discharged from the fixing nip N, the heated portion of the fixing roller 20 having passed through the fixing nip N and now cooled by the recording medium P returns to an opposed position where the fixing roller 20 is disposed opposite the induction heater 25. Thus, a series of the above-described processes is repeated, completing the fixing process constituting a part of the image forming processes.

The fixing device 19 depicted in FIG. 2 includes the induction heater 25 that heats the fixing roller 20 by electromagnetic induction. Alternatively, the induction heater 25 may be replaced by a halogen heater. Further, the fixing roller 20 and/or the pressing roller 30 may be replaced by a fixing belt and/or a pressing belt. The exemplary embodiment described above is one example of the fixing device 19 and therefore the configuration of the fixing device 19 is not limited to the configurations described above.

Referring to FIGS. 2 and 3, the following describes the thermopile 34.

As illustrated in FIG. 2, the thermopile 34 is situated at a position below the fixing nip N in a vertical direction and is disposed opposite an outer circumferential face of the induction heater 25 opposite an inner circumferential face thereof facing the fixing roller 20 at a lower part of the induction heater 25. As shown in FIG. 3, a tube 35 penetrates a lower part of the induction heater 25 in such a manner that the tube 35 is inserted through a gap between wires of the coil 26. It is to be noted that the tube 35 is omitted in FIG. 2.

The tube 35 is made of a heat resistant resin or the like and has two openings, that is, an inlet 35A at one end and an outlet 35B at another end of the tube 35 in a longitudinal direction thereof. The inlet 35A is disposed opposite a lower part of the outer circumferential surface of the fixing roller 20; the outlet 35B is disposed opposite and in proximity to a detecting face 34*a* of the thermopile 34 that detects the temperature of the fixing roller 20. With this configuration, an inner diameter of the tube 35 defines an aperture angle of the tube 35, that is, a viewing angle of the detecting face 34*a* of the thermopile 34, thus prohibiting entry of infrared rays from components other than the fixing roller 20 to the detecting face 34*a* of the thermopile 34. The tube 35 also allows heat to escape from an interval between the outer circumferential surface of the fixing roller 20 and the inner circumferential surface of the coil guide 28 to the outer circumferential face of the induction heater 25.

Further, as the recording medium P bearing the unfixed toner image T is conveyed through the fixing nip N, heat conducted from the fixing roller 20 and the pressing roller 30 vaporizes water from the recording medium P into steam and volatilizes wax from toner of the unfixed toner image T. To address this circumstance, the thermopile 34 is situated below the fixing nip N in the vertical direction to minimize adhesion of steam and volatilized wax to the thermopile 34. For example, steam and wax volatilized at the fixing nip N are moved upward by up-current of air generated by temperature differential. Since the thermopile 34 is situated below the fixing nip N in the vertical direction, the thermopile 34 is less likely to contact an atmosphere of steam and volatilized wax, preventing adhesion of steam and volatilized wax to the thermopile 34. As a result, the thermopile 34 detects the temperature of the fixing roller 20 precisely, preventing system failure and faulty fixing.

As shown in FIG. 2, a heat conductive metal bracket 70 is attached to a lower face of the frame 29 of the induction heater 25. A dehumidifier 72 containing a desiccant such as silica gel is mounted on a lower face of the bracket 70. The position of the dehumidifier 72 is not restricted in view of decreasing an amount of water, that is, moisture content, in the fixing device 19. For example, according to this exemplary embodiment, the dehumidifier 72 is disposed in proximity to the thermopile 34 to minimize adhesion of moisture and water to the thermopile 34 effectively. Radiation heat generated by the induction heater 25 toward the fixing roller 20 heats the frame 29 which in turn heats the bracket 70, heating the desiccant of the dehumidifier 72 mounted on the bracket 70 for continuous use.

Figure 4:
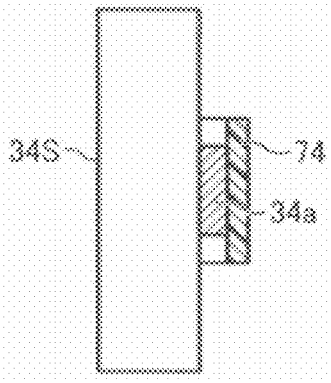
FIG. 4 is a vertical sectional view of a thermopile and a protector incorporated in the fixing device shown in FIG. 3 according to a second embodiment.

Referring to FIG. 4, the following describes a second embodiment.

FIG. 4 is a vertical sectional view of a thermopile 34S and a protector 74 according to the second embodiment. Unlike the thermopile 34 shown in FIG. 3 according to the first embodiment, the thermopile 34S according to the second embodiment has the protector 74 attached to the detecting face 34*a* of the thermopile 34S. The protector 74 prohibits adhesion of a foreign substance to the detecting face 34*a* of the thermopile 34S while allowing infrared rays to penetrate the protector 74. For example, the protector 74 is made of a material having fine pores such as Gore-Tex®. Accordingly, even when an atmosphere containing steam and volatilized wax reaches the thermopile 34S through the tube 35 depicted in FIG. 3, the protector 74 prevents the steam and volatilized wax from adhering to the detecting face 34*a* of the thermopile 34S while allowing air containing heat and infrared rays to penetrate the protector 74. Consequently, the thermopile 34S detects the temperature of the fixing roller 20 precisely via the air penetrating the protector 74.

Figure 5:
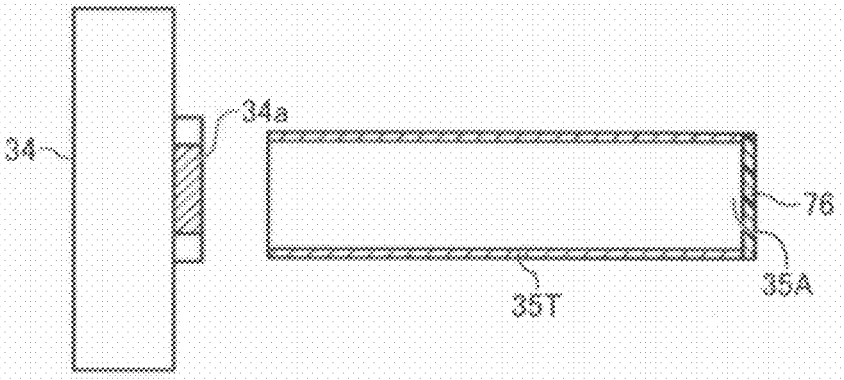
FIG. 5 is a vertical sectional view of the thermopile and a tube incorporated in the fixing device shown in FIG. 3 according to a third embodiment.

Referring to FIG. 5, the following describes a third embodiment.

FIG. 5 is a vertical sectional view of the thermopile 34 and a tube 35T according to the third embodiment. Unlike the tube 35 shown in FIG. 3 according to the first embodiment, the tube 35T according to the third embodiment is attached with a filter 76 that allows penetration of infrared rays only. As shown in FIG. 5, the filter 76 is attached to a circumferential edge creating the inlet 35A of the tube 35T which faces the fixing roller 20. Alternatively, the filter 76 may be attached to other position. The filter 76 prevents adhesion of a foreign substance to the detecting face 34*a* of the thermopile 34 and protects the thermopile 34 at decreased costs without modification of the configuration of the thermopile 34. The filter 76 is made of a heat resistant material such as polycarbonate, glass, and resin. The filter 76 has a thickness not greater than about 200 micrometers that maintains a predetermined permeability of infrared rays, thus preventing faulty detection of the thermopile 34.

Figure 6:
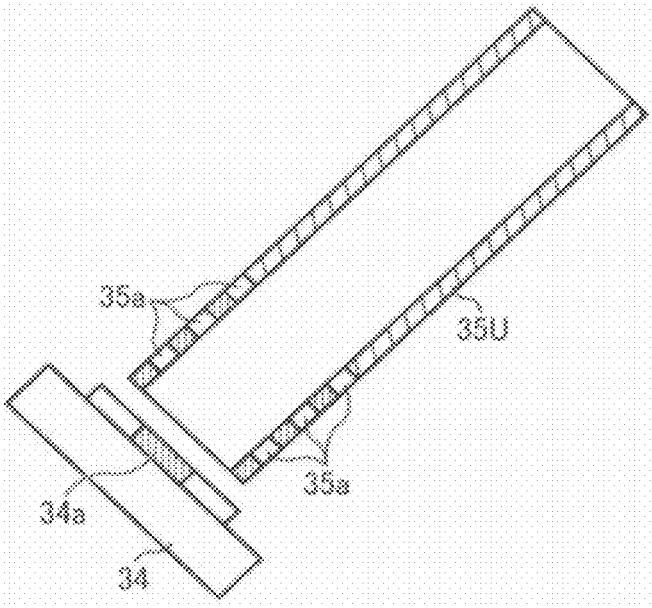
FIG. 6 is a vertical sectional view of the thermopile and a tube incorporated in the fixing device shown in FIG. 3 according to a fourth embodiment.

Referring to FIG. 6, the following describes a fourth embodiment.

FIG. 6 is a vertical sectional view of the thermopile 34 and a tube 35U according to the fourth embodiment. Unlike the tube 35 depicted in FIG. 3 according to the first embodiment, the tube 35U according to the fourth embodiment is provided with a plurality of vents 35*a* at a side wall thereof. The vents 35*a* change airflow inside the tube 35U. The changed airflow directs steam and volatilized wax entering the tube 35U to the vents 35*a*. Accordingly, the stream and volatilized wax are discharged from the tube 35U through the vents 35*a* disposed upstream from the thermopile 34 in a direction of airflow before they reach the thermopile 34. Specifically, most of the steam and volatilized wax are discharged through the upper vents 35*a*. The vents 35*a* are produced through an upper wall and a lower wall of the side wall of the tube 35U tilted from the horizontal in such a manner that the upper vents 35*a* are disposed opposite the lower vents 35*a*. Like the upper vents 35*a*, the lower vents 35*a* discharge the steam and volatilized wax. Additionally, the lower vents 35*a* prevent the steam and volatilized wax from accumulating inside the tube 35U. Thus, even when an atmosphere containing steam and volatilized wax enters the tube 35U, the vents 35*a* minimize an amount of steam and volatilized wax that reach the thermopile 34, preventing detection error of the thermopile 34 and resultant system failure and faulty fixing.

According to the first to fourth embodiments described above, the thermopile (e.g., the thermopiles 34 and 34S) and the tube (e.g., the tubes 35, 35T, and 35U) are situated below the fixing nip N in the vertical direction in the fixing device 19 incorporated with the induction heater 25 as shown in FIG. 3. Alternatively, the thermopile and the tube may be installed in fixing devices using heaters other than the induction heater 25. In such fixing devices also, the thermopile and the tube minimize steam and volatilized wax that contact the thermopile, preventing detection error of the thermopile and resultant system failure and faulty fixing. Further, the tube may be disposed between the thermopile and the fixing rotary body (e.g., the fixing roller 20), removing noise, that is, infrared rays from the components other than the fixing rotary body.

With the simple configurations according to the first to fourth embodiments described above, the non-contact temperature detector (e.g., the thermopiles 34 and 34S) detects the temperature of the fixing rotary body (e.g., the fixing roller 20) precisely, preventing detection error of the non-contact temperature detector and resultant system failure and faulty fixing at decreased costs.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation to radiate infrared rays;

a pressing rotary body, rotatable in a direction counter to the direction of rotation of the fixing rotary body, pressed against the fixing rotary body to form a fixing nip therebetween through which a recording medium bearing a toner image is conveyed;

a heater disposed opposite the fixing rotary body to heat the fixing rotary body;

a temperature detector spaced apart from the fixing rotary body to detect a temperature of the fixing rotary body based on the infrared rays from the fixing rotary body and disposed below the fixing nip in a vertical direction; and a tube which penetrates through the heater and is disposed between the fixing rotary body and the temperature detector, the tube positioned such that the infrared rays from the fixing rotary body pass through the heater via the tube and then enter the temperature detector.

2. The fixing device according to claim 1, wherein the temperature detector includes a thermopile.

3. The fixing device according to claim 1, wherein the temperature detector includes a detecting face disposed opposite the fixing rotary body via the tube.

4. The fixing device according to claim 3, wherein an inner diameter of the tube defines a viewing angle of the detecting face of the temperature detector.

5. The fixing device according to claim 3, further comprising a protector attached to the detecting face of the temperature detector to protect the detecting face of the temperature detector against a foreign substance, the protector through which the infrared rays from the fixing rotary body penetrate.

6. The fixing device according to claim 3, further comprising a filter disposed between the fixing rotary body and the temperature detector to protect the detecting face of the temperature detector against a foreign substance, the filter through which the infrared rays from the fixing rotary body penetrate.

7. The fixing device according to claim 6, wherein the filter is attached to the tube.

8. The fixing device according to claim 3, further comprising a dehumidifier disposed in proximity to the temperature detector to protect the detecting face of the temperature detector against moisture and water.

9. The fixing device according to claim 8, wherein the dehumidifier includes a desiccant.

10. The fixing device according to claim 8, further comprising a metal bracket disposed between the fixing rotary body and the dehumidifier and attached with the dehumidifier to conduct heat from the fixing rotary body to the dehumidifier.

11. The fixing device according to claim 1, wherein the tube includes a plurality of vents produced through a side wall of the tube.

12. The fixing device according to claim 11, wherein the tube is tilted from a horizontal and the plurality of vents includes upper vents produced through an upper wall of the side wall of the tube and lower vents produced through a lower wall of the side wall of the tube.

13. The fixing device according to claim 1, wherein the fixing rotary body includes one of a fixing roller and a fixing belt and the pressing rotary body includes one of a pressing roller and a pressing belt.

14. The fixing device according to claim 1, wherein the heater includes one of an induction heater and a halogen heater.

15. An image forming apparatus comprising the fixing device according to claim 1.

* * * * *